United States Patent [19]

Waas

[11] 3,931,780

[45] Jan. 13, 1976

[54] ICEBREAKER VESSEL

[76] Inventor: Heinrich Waas, Bramfelder Strasse 164, 2000 Hamburg 33, Germany

[22] Filed: July 18, 1974

[21] Appl. No.: 489,488

[30] Foreign Application Priority Data

Aug. 30, 1973 Germany ..... 2343719
June 14, 1974 Germany ..... 2428801

[52] U.S. Cl. ..... 114/41; 114/56
[51] Int. Cl.[2] ..... B63B 35/08
[58] Field of Search ..... 114/40–42, 114/56, 60, 63, 26

[56] References Cited

UNITED STATES PATENTS

| | | | |
|---|---|---|---|
| 2,791,980 | 5/1957 | Best, Jr. | 114/60 |
| 3,092,066 | 6/1963 | Jönsson | 114/40 |
| 3,439,643 | 4/1969 | Andrea | 114/63 |
| 3,521,591 | 7/1970 | Alexander | 114/41 |
| 3,584,591 | 6/1971 | Fournier | 114/125 |
| 3,636,904 | 1/1972 | Blanchet | 114/41 |
| 3,678,873 | 7/1972 | Bennett | 114/42 |
| 3,690,281 | 9/1972 | Gray | 114/41 |

*Primary Examiner*—Trygve M. Blix
*Assistant Examiner*—Stuart M. Goldstein
*Attorney, Agent, or Firm*—Toren, McGeady and Stanger

[57] ABSTRACT

An icebreaker vessel having a forecastle of a pontoon-shaped configuration and of a greater width than the width of the ship's hull wherein an upper portion of the lower surface of the forecastle is substantially planar and inclined upwardly, and a lower portion gradually merges into a wedge-shaped portion with a central keel. The forecastle may be equipped with heat generating and/or heat transfer devices, with ice cutting devices and/or with water discharge orifices. The icebreaker vessel may include a trimming apparatus.

6 Claims, 8 Drawing Figures

ICEBREAKER VESSEL

The present invention relates to an icebreaker vessel of a specific forecastle design.

In recent years, the development of ships designed for passing through thick ice has led to more and more powerful engine outputs, and these in turn render the economy of operation of such ships questionable, due to the rather high costs of the machinery.

In the course of this development, the already long ago introduced shape of a pointed bow or forecastle in icebreaker vessels has generally been retained but for minor modifications, although this configuration entails various drawbacks, especially for the passage through continuous ice sheets. Although the inclined stem of an approximately wedge-shaped cross-section will be pushed onto the ice sheet by means of the propeller thrust and subsequently the stem fractures the ice sheet by its weight, this fracturing is essentially confined to a central region only. The channel thus formed has subsequently to be widened to conform to the width of the ship, and this widening is accompanied by the so-called "shoulder effect" which is very wasteful in terms of the energy required for overcoming this effect. Another drawback is that floes may become jammed in the narrow channel between the ship's side wall and the rigid ice sheet, and produce high frictional resistance forces.

Although there are known apparatus for cutting the ice in front of the forecastle such apparatus in combination with the ship result in mechanisms that appear as being rather fragile when considering the excessive display of forces involved in icebreaking operations.

There have likewise been tested with good results, in continuous ice sheets, some forecastle configurations of a greater width. These heretofore known configurations, however, do not push aside the floes of drift ice and packice. When varying ice formations such as drift ice and pack-ice must be expected, the known ship configurations are unsuitable.

It is now an object of the present invention to provide a novel and improved icebreaker vessel.

It is another object of the present invention to provide an icebreaker vessel that is suitable for the most varied ice conditions, that may be operated more economically than heretofore known icebreaker vessels and wherein the drawbacks pointed out above are eliminated.

It is still another object of the present invention to provide an icebreaker vessel having a forecastle of an unique configuration facilitating a lateral removal of broken floes underneath a laterally disposed stationary ice sheet.

In accordance with the present invention, there is now proposed an icebreaker vessel in which the forecastle of the ship's hull above the water line is of a pontoon shaped configuration, this pontoon shaped forecastle including parallel spaced side walls and a front surface extending across the whole width of the ship, a lower portion of the front surface being substantially planar and inclined upwardly, in including an acute angle with a horizontal plane, a portion of the front surface below the water line gradually merging into a wedge-shaped portion with a central keel.

In accordance with another feature of the present invention the vessel is provided with a trimming apparatus of a type well known in the art for lifting the forecastle until the wedge-shaped portion emerges above the water line, or for lowering the forecastle until the lower edge of the front surface lies approximately at the level of the lower surface of an ice sheet.

For further improving the icebreaking properties of the vessel, the forecastle may be provided, on either side and in the region of its largest width with a sharp-edged bilge mounting downwardly directed teeth. Moreover, heat generating devices may be provided in the vicinity of the front surface and of the bilges.

In accordance with another embodiment of the present icebreaker vessel, one or a plurality of discharge orifices for discharging sea water may be provided at either side of the forecastle in the ship's body within the bilge region and below the water line, and these discharge orifices are connected by an intake manifold with an in-line pump to an inlet port in the ship's bottom.

Although it is known in the prior art to draw sea water up from the ship's bottom for utilization to break the ice and to bring it to a very high pressure in order to cut the ice with the water jet acting upon the ice through air, in the present invention the ice is not cut by a water jet. Instead, the broken ice floes under the ice breaker vessel are laterally accelerated by the current produced beneath the vessel such that the broken floes cannot enter the gap between the hull and the solid ice cover.

In the following, an illustrative embodiment of the icebreaker vessel of the present invention will be described more in detail with reference to the appended drawings wherein FIG. 1 is a perspective bottom view of the forecastle of an icebreaker vessel in accordance with the present invention;

Figure 1:
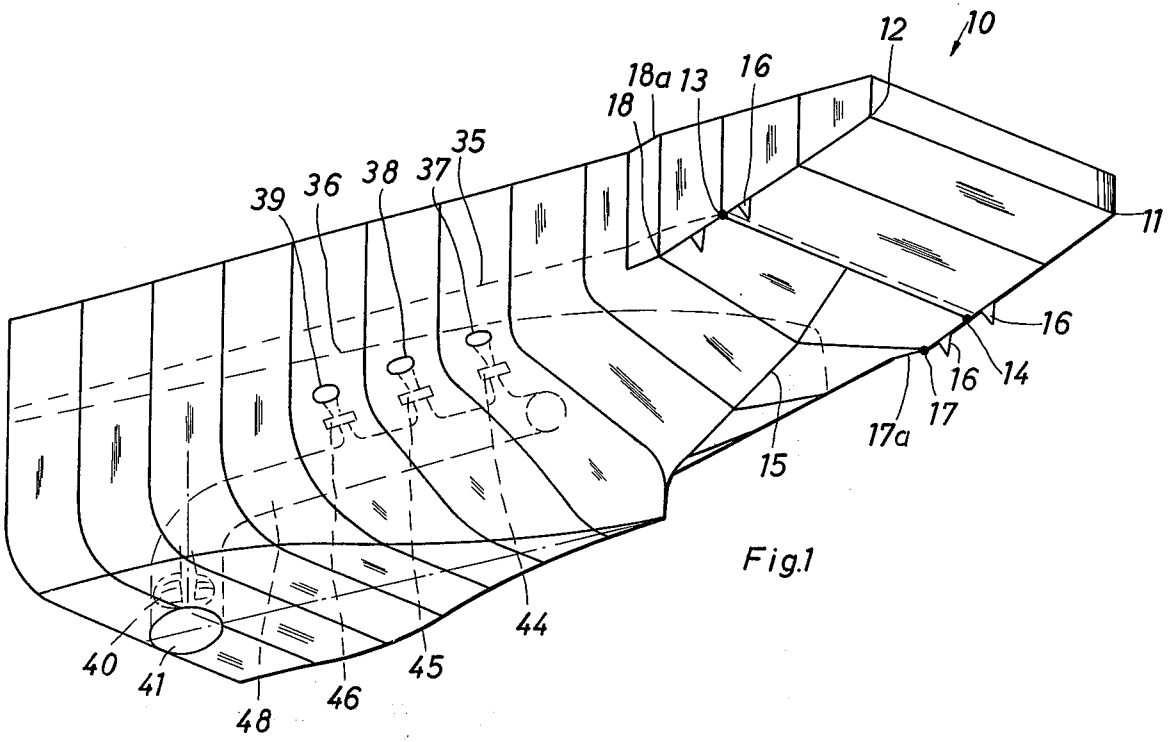
FIG. 1A is a side elevation of the forecastle of the invention.
FIG. 1B is a schematic front view of the forecastle.

Referring to FIG. 1, the forecastle 10 of the ship's hull of an icebreaker vessel is of what may be termed a pontoon configuration, and the front portion thereof includes an upwardly and forwardly inclined front surface defined by the corners 11, 12, 13 and 14. Above the water line, this front surface is approximately planar. The lateral edges of the front surface are sharp-edged. The effect of these sharp-edged sides may be enhanced by saw teeth 16.

At some distance below the water line, the forwardly inclined front surface of the forecastle merges gradually into a wedge-shaped portion with a central keel 15. The width of the forecastle 10 from the forward end up to the points 17 and 18 is about the same or even somewhat larger than the width of the remaining part of the ship's hull. Behind these points 17, 18 the width of the forecastle 10 markedly decreases, in forming an inclined shoulder 17*a*, 18*a*.

Figure 1A:
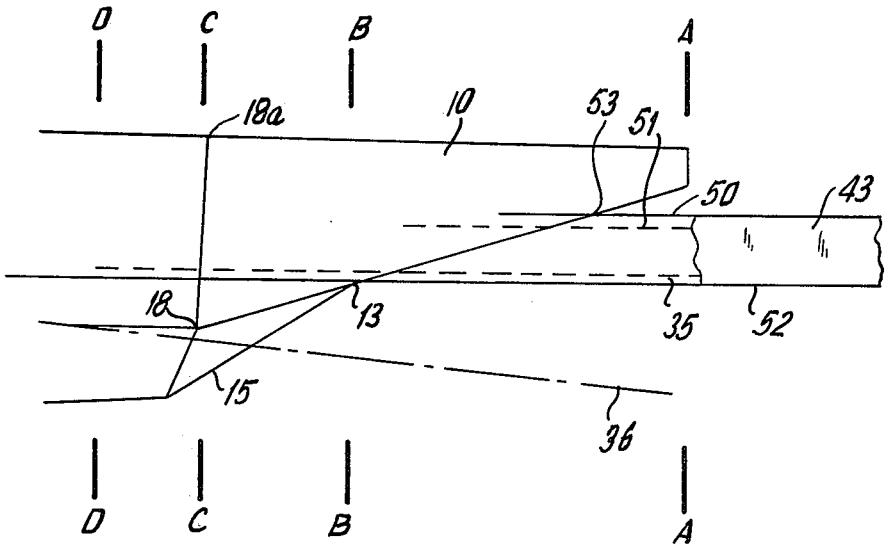
Figure 1B:
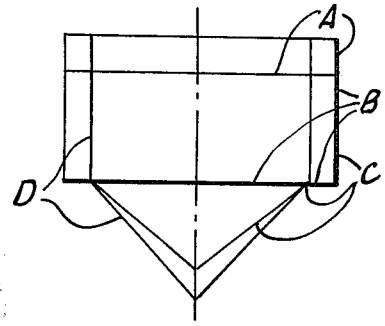

The shape and design of the forecastle shown in FIG. 1 are further illustrated in FIGS. 1A and 1B. In FIG. 1A, sections of the forecastle are denoted by schematic representations of frame members A, B, C and D. The frame members A—A, B—B, C—C and D—D shown in FIG. 1A are also depicted in FIG. 1B with the frames A, B, C and D shown in FIG. 1B corresponding to the sections A—A, B—B, C—C, and D—D shown in FIG. 1A.

Figure 5:
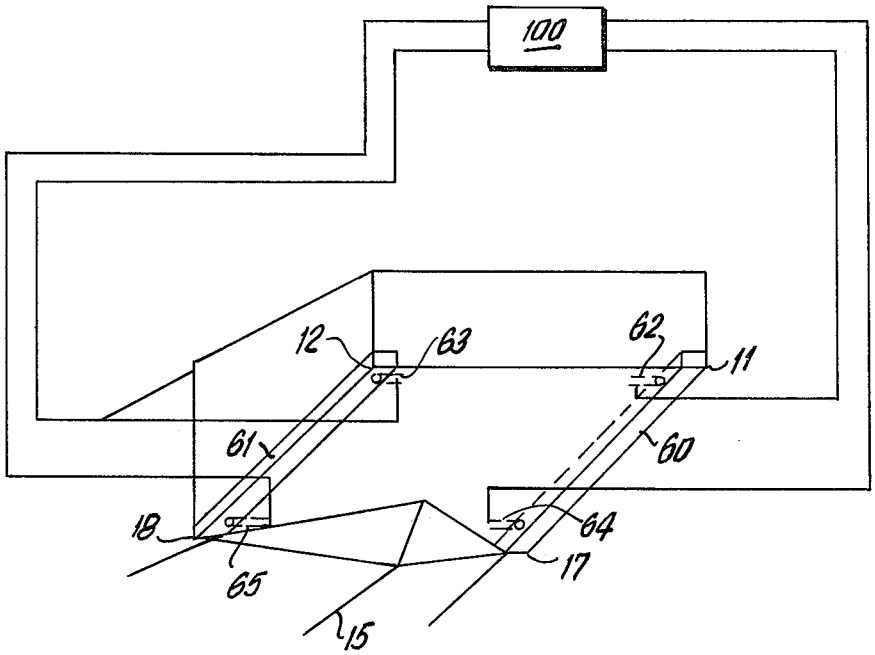
FIG. 5 is a schematic view showing flat heating tanks utilized with the present invention.

Adjacent the front surface and in the vicinity of the water line there are provided flat tanks 60, 61 shown in FIG. 5 which serve as an internal heating device for heating the ship's skin by cooling water heated up in the ship's engine.

As will be seen from FIG. 1, the forwardly inclined planar surface of the forecastle blends gradually into a wedge-shaped form with the center keel 15 under the water line. The width of the forecastle 10 from the front part thereof up to the points 17 and 18 is about equal or even greater than the width of the balance of the vessel. After points 17, 18, the width of the forecastle diminishes in a clear break 17*a*, 18*a*. In the range of the front face close to the water line, the narrow tanks 60 and 61 shown in FIG. 5 are provided in order to heat the ship's skin from cooling water obtained during operation of the engines. The tanks 60, 61 are designed as rectangular thickwalled pipes so that they can withstand great forces of the ice upon the hull. The tanks 60, 61 are connected in a closed cooling water cycle including the engine plant 100 at the front top by feed pipes 62 and 63 and at the rear bottom by feed pipes 64 and 65.

One or several orifices 37, 38 and 39 may be provided in the region of the bilges in the ship's wall below the water line 36. These orifices 37–39 are connected by an intake manifold 48 with an in-line pump 40 to an inlet port 41 at the ship's bottom. Sea water is drawn in through the inlet port 41 by the pump 40 and is discharged through the orifices 37–39 (see FIG. 1).

The method of operation of the inventive icebreaker vessel depends upon the ice conditions and differs for a continuous, uninterrupted ice sheet from the method of operation in ice fields with open water patches. The effect of the icebreaker vessel is likewise different under both conditions.

In a continuous uninterrupted ice sheet the effect is as follows: The forecastle of the advancing ship loads the unbroken ice sheet substantially on both sides, i.e. along the port side between the corners 11 and 14, and along the starboard side between the corners 12 and 13. Under the gradually increasing pressure of the vessel moving onto the ice sheet the latter finally becomes fractured, and this fracturing occurs along an approximately straight line parallel to the ship's side, at either side thereof. These fracturing lines define a channel of a greater width than the ship's hull. In very hard ice, this fracturing may be facilitated by the saw teeth 16 which penetrate into the ice during advancement of the ship.

Figure 4:
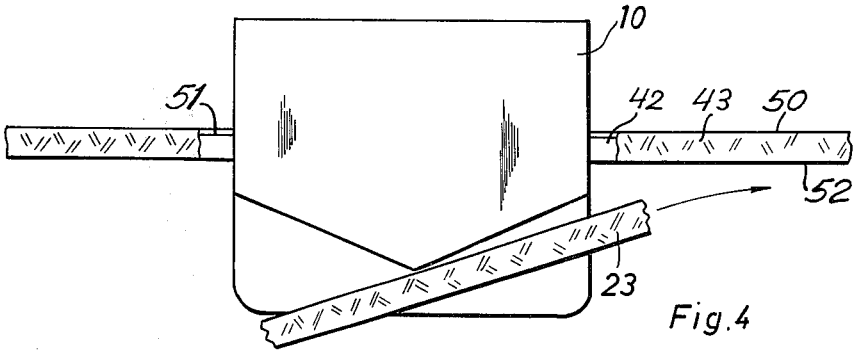
FIG. 4 is a front elevational view for explaining the operation of an icebreaker vessel as shown in FIG. 3.

Referring now to FIG. 1A, with a closed ice cover, the forecastle 10 approaches an ice cover 43 which floats on the water surface 51 moving from left to right as seen in FIG. 1A. The upper edge 50 of the ice cover 43 is somewhat higher than a lower edge 52 thereof which is much lower than the water surface 51. At the point 53, the forecastle engages the ice after a short run and following an additional run the forecastle 10 rises while the ice cover 43 drops. The contact point, which is initially shown at 53, moves approximately up to the point 13 where the breaking limit for breaking an ice floe is reached. The floe corresponding to the width of the ship now glides deeper on the line 15 until it reaches a position shown in FIG. 4, or slightly below this position. With a continued run of the ice breaker vessel, this cycle continues. The successively broken floes are all generally rectangular. Thus, behind the ice breaker vessel there is formed a channel which is somewhat wider than the width of the vessel.

The wide forecastle portion overlying the still unfractured ice sheet provides the additional advantage that this forecastle is much more suitable than ship's bodies of conventional configuration for mounting the well-known devices or tools for cutting the ice.

Figure 2:
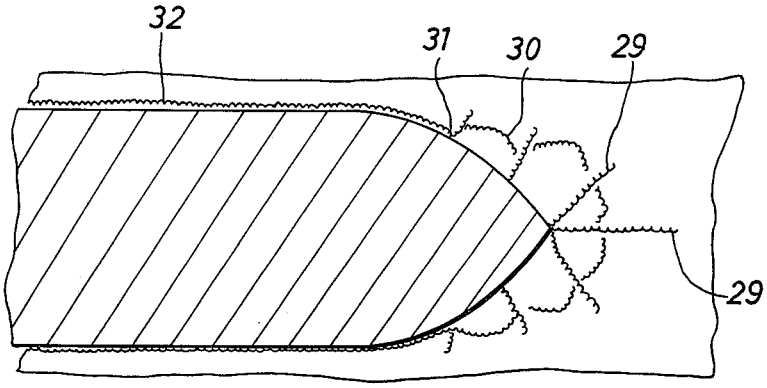
FIG. 2 is a schematical top view for explaining the operation of an icebreaker vessel having a forecastle of a conventional configuration.
Figure 3:
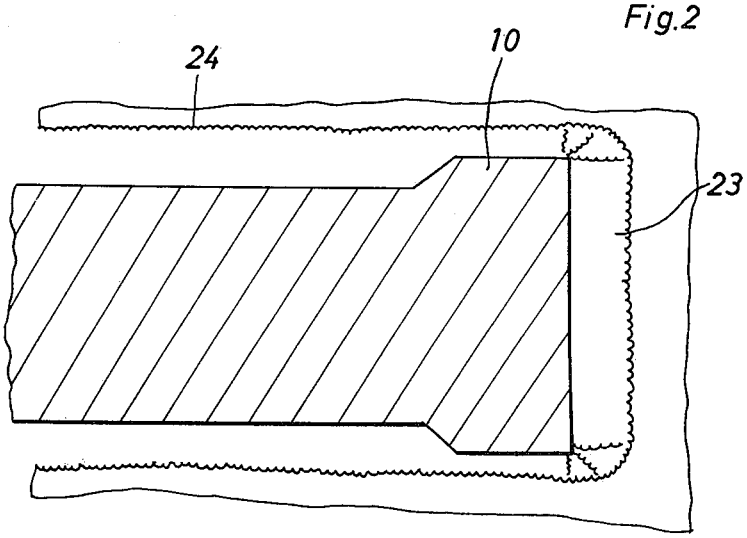
FIG. 3 is a schematical top view for explaining the operation of an icebreaker vessel of a forecastle configuration as shown in FIG. 1, in accordance with the present invention.

For explaining the ice breaking effect of the novel icebreaker vessel, FIGS. 2 and 3 illustrate the fracturing of an ice sheet with a prior art icebreaker having a conventional forecastle configuration and with the inventive icebreaker having the forecastle configuration 10 as shown in FIG. 1 respectively.

Figure 6:
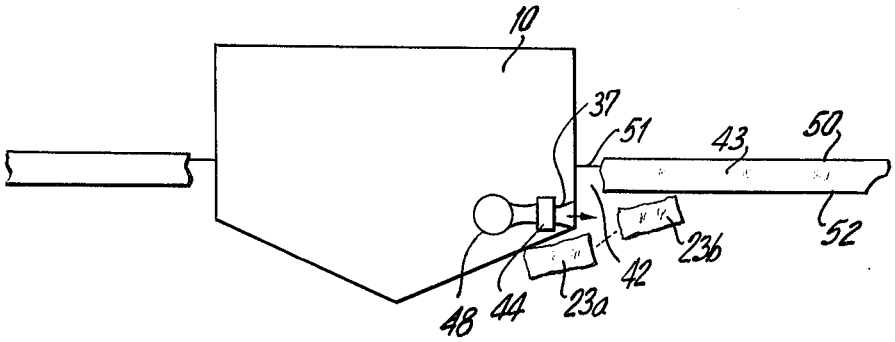
FIG. 6 is a schematic front view of the invention illustrating movement of the broken ice floes.

FIG. 2 shows the pattern of fracture lines for a conventional vessel. The radial fracture lines 29 and the arcuate fracture lines 30 result in a squeezing action at 31 (shoulder effect), and in cutting of a narrow channel 32. In contrast thereto, the forecastle configuration 10 produces the fracture lines shown in FIG. 3. Although these fracture lines likewise extend radially and arcuately, these fracture lines do not result in any squeezing action. The channel 24 is wider than the channel 32 of FIG. 2. In the broad central region there will be cut substantially larger floes 23 than in the case of FIG. 2. These larger floes slip underneath the vessel as shown in the cross-section of FIG. 4. Underneath the wedge-shaped portion of the forecastle the floes will be brought into an unstable position, due to their buoyancy, and consequently tilt to the one or to the other side. The succeeding cross-sections of the ship's forecastle which conform more and more to the shape of the main frame element of cross-section, the floes are pushed sidewards underneath the continuous ice sheet. This operation is facilitated especially in the case of smaller floes 23*a*, 23*b* shown in FIG. 6 that may more readily be pushed into the gap 42 between the ship's body 10 and the rigid ice sheet 43, by the sea water discharged through the orifices 37, 38 and 39.

For the economy of energy consumption, some of these orifices 37–39 may be blocked by means of respective gate valves 44, 45 and 46. Some of these orifices 37-39 may be blocked if these orifices have a reduced effectiveness under certain ice conditions. Any desired number of orifices 37–39 may be provided (see FIG. 1).

The aforedescribed method of icebreaking provides furthermore the advantage that a substantially ice-free channel may be formed behind the vessel, unless current or wind influences move the ice such as a continuous ice sheet.

Since the forecastle configuration 10 shown in FIG. 1 engages the ice sheet across the whole width of the forecastle, this action is accompanied by increased friction forces, in comparison to pointed bows of conventional icebreaker vessels, and concentrates these forces along the edges 12–18 and 11–17. With this novel forecastle configuration 10 it is therefore particularly advantageous to employ the known method of heating the ship's skin for reducing the friction thereof against the ice. This heating may be performed in a most economical manner by the flat tanks 60, 61 shown in FIG. 5 which extend along the lines 12–18 and 11–17 where the major portion of the vertical ice pressure on the hull is absorbed. Such flat tanks are heated by means of cooling water discharged from the ship's engine. The heating is thus limited to a very small part of the hull and is performed in an economical manner for this reason.

When the icebreaker vessel passes through an ice sheet that is interrupted by patches of open sea, or through pack-ice, the vessel must be trimmed to be down by the stern so that the water line will be shifted into a new position 36. The method of operation will then be as follows: The forecastle will be lifted upwardly to such an extent that the planar portion of the front surface ahead of a line connecting the corners 13 and 14 does no longer engage or substantially does not engage the ice and the V-shaped portion behind the line connecting the corners 13 and 14 will be pushed onto the ice that is to be fractured or intended to be removed from underneath the vessel in a lateral direction. In this manner, the ice will be pushed away in a laterally and downwardly extending direction.

The two above explained different conditions under which an icebreaker vessel must operate in ice therefore require different trim positions of the vessel, for optimum operation. The additionally required technical apparatus are worth while since apparatus for modifying the trim position of a vessel may also be used for freeing the vessel when this should become stuck in impenetrable ice. The down-by-the-bow trim position will be used in continuous uninterrupted and approximately even ice sheets whereas the down-by-the-stern trim position will be used in open seas, in drift ice or in pack-ice.

What is claimed is:

1. An ice breaker vessel including a ship's hull having a forecastle comprising:

a bow of said vessel extending in a generally linear configuration across said forecastle from port to starboard substantially at the upper most portion of said forecastle;

a substantially planar section extending downwardly and astern of said bow in a generally quadrilateral configuration contiguously with said bow and substantially across said entire vessel from port to starboard; and a keel portion having an acuminated configuration directed forwardly of said vessel located astern of said planar section and having a configuration extending contiguously therewith.

2. A vessel according to claim 1 including heat generating means provided interiorly of said forecastle adjacent said planar section on opposite sides thereof.

3. A vessel according to claim 2 wherein said heat generating means comprise a pair of elongated tubular tanks extending fore-to-aft of said vessel adjacent said planar section on opposite sides thereof.

4. A vessel according to claim 1 wherein said planar section comprises a width dimension extending across said vessel from port to starboard and wherein said width dimension of said planar section progressively decreases taken in a direction astern of said vessel from said bow.

5. A vessel according to claim 1 having a bilge region and a water line and including a plurality of discharge orifices for discharging sea water, said orifices being provided at either side of the forecastle in the body of said vessel within said bilge region and below said water line, said discharge orifices being connected by an intake manifold with an in-line pump to an inlet port of the ships hull.

6. A vessel according to claim 5 wherein each of said discharge orifices includes gate valve means for opening and closing said orifices.

* * * * *